US009132989B2

(12) United States Patent
Norikane et al.

(10) Patent No.: US 9,132,989 B2
(45) Date of Patent: Sep. 15, 2015

(54) RECORDING APPARATUS

(71) Applicants: Shunsuke Norikane, Nagoya (JP); Masayuki Okumura, Nagoya (JP)

(72) Inventors: Shunsuke Norikane, Nagoya (JP); Masayuki Okumura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/191,641

(22) Filed: Feb. 27, 2014

(65) Prior Publication Data

US 2014/0239582 A1 Aug. 28, 2014

(30) Foreign Application Priority Data

Feb. 28, 2013 (JP) ..... 2013-039111

(51) Int. Cl.
*B65H 9/16* (2006.01)
*B65H 85/00* (2006.01)
*B65H 5/06* (2006.01)

(52) U.S. Cl.
CPC ..... *B65H 85/00* (2013.01); *B65H 5/062* (2013.01); *B65H 9/166* (2013.01); *B65H 2301/3613* (2013.01); *B65H 2404/117* (2013.01); *B65H 2404/1115* (2013.01); *B65H 2404/133* (2013.01); *B65H 2404/1342* (2013.01); *B65H 2404/1345* (2013.01); *B65H 2404/13421* (2013.01); *B65H 2404/1431* (2013.01); *B65H 2404/611* (2013.01)

(58) Field of Classification Search
CPC ..... B65H 2404/1119; B65H 2404/117; B65H 2404/1342; B65H 2404/13421; B65H 2404/1345; B65H 2301/443246; B65H 2301/44318; B65H 2301/3613
USPC ..... 271/248, 250, 251; 347/104
See application file for complete search history.

(56) References Cited

U.S. PATENT DOCUMENTS 5,795,087 A * 8/1998 Brower et al. ..... 400/636
8,360,414 B2 * 1/2013 Lo et al. ..... 271/109
8,919,772 B2 * 12/2014 Okumura ..... 271/251

FOREIGN PATENT DOCUMENTS

JP 2000-128396 5/2000
JP 2000-233850 8/2000

* cited by examiner

*Primary Examiner* — Howard Sanders
(74) *Attorney, Agent, or Firm* — Frommer Lawrence & Haug LLP

(57) ABSTRACT

There is provided a recording apparatus including a recording unit and a transporting mechanism to transport a recording medium. The transporting mechanism includes, a guide surface to guide an end portion, of the recording medium, in a direction intersecting with a transporting direction of the recording medium, and a pair of rollers arranged, in a direction orthogonal to the guide surface, at a position between the guide surface and a central portion of the transporting path. The pair of rollers includes, a driving roller to transport the recording medium, and a driven roller having a rotary portion facing a recording surface, of the recording medium, on which the image is recorded, and configured to rotate about a rotation axis thereof following movement of the recording medium, and a first shaft to support the rotary portion rotatably. The rotary portion is supported rockably with respect to the first shaft.

20 Claims, 6 Drawing Sheets

RECORDING APPARATUS

CROSS REFERENCE TO RELATED APPLICATION

The present invention claims priority from Japanese Patent Application No. 2013-039111, filed on Feb. 28, 2013, the disclosure of which is incorporated herein by reference in its entirety.

BACKGROUND OF THE INVENTION

1. Field of the Invention

The present invention relates to a recording apparatus which performs recording of an image.

2. Description of the Related Art

Japanese Patent Application Laid-open No. 2000-233850 describes, in particular in FIGS. 2 and 4, an image forming apparatus including an image forming section and a transporting section which transports a sheet (recording medium) on which an image has been recorded in the image forming section. The transporting section of the image forming apparatus has a lateral register correcting means for correcting the position of the sheet to a predetermined position in a width direction and along a reference surface. The lateral register correcting means has a reference plate having the reference surface, a pair of transporting rollers composed of a lateral register correcting roller of which rotation axis is perpendicular to the reference surface and an oblique transporting roller of which rotation axis is inclined with respect to the reference surface. The pair of transporting rollers is arranged on a side closer to the reference surface than the central portion of the sheet, with respect to the width direction of the sheet.

In such a lateral register correcting means, when the pair of transporting rollers nips the sheet, the sheet is rotated such that a rear end portion of the sheet approaches closer to the side of the reference surface. Then, when the sheet is brought into contact or abutment with the boundary line between the reference surface and a tapered surface of the reference plate, the sheet is counter-rotated due to the counteraction of the abutment such that a forward end portion of the sheet approaches closer to the reference surface. As a result, the sheet is adjusted (the sheet is positioned) to the position along the reference surface, and is transported along the reference surface. In such a manner, the skew correction or oblique travel correction for the sheet is performed.

In the lateral register correcting means of the image forming apparatus descried in Japanese Patent Application Laid-open No. 2000-233850, in a case that an advancing direction of the sheet is greatly different from the rotational direction of the oblique transporting roller, the rotational load on the oblique transporting roller becomes great. In a case that the rotational load on the oblique transporting roller is great, the oblique transporting roller itself might become hard to rotate, which in turn prevents the sheet from being transported and thus causes any jam of sheet, and/or might causes the oblique transporting roller to slip with respect to the sheet in some cases. In a case that the oblique transporting roller slips with respect to the sheet, a problem such as disturbance of the image on the sheet might occur.

An object of the present teaching is to provide a recording apparatus which is capable of suppressing the increase in rotational load on a driven roller.

SUMMARY OF THE INVENTION

According to an aspect of the present teaching, there is provided a recording apparatus including:

a recording unit configured to record an image on a recording medium; and a transporting mechanism configured to transport the recording medium in a transporting direction along a transporting path through which the recording medium is transported; wherein the transporting mechanism includes: a guide surface which extends in a linear manner and which is configured to guide a side edge of the recording medium; and a pair of rollers arranged, in an orthogonal direction orthogonal to the guide surface, at a position between the guide surface and a central portion in the orthogonal direction of the transporting path, the pair of rollers being configured to transport the recording medium by rotating while holding the recording medium between the pair of rollers; wherein the pair of rollers includes: a driving roller configured to transport the recording medium; and a driven roller including: a rotary portion facing a recording surface, of the recording medium, and configured to rotate following movement of the recording medium; and a first shaft inserted through the rotary portion and configured to support the rotary portion rotatably in a circumferential direction of the first shaft; and wherein the rotary portion is supported rockably with respect to the first shaft.

According to the recording apparatus of the present teaching, the skew correction is performed by utilizing the configuration, in which the pair of rollers is arranged at the position closer to the guide surface than the central portion of the transporting path (the position between the guide surface and the central portion of the transporting path), so as to transport the recording medium along the guide surface. In this case, the rotary portion is supported rockably with respect to the first shaft portion, and thus the rotary portion rocks (shifts) in accordance with the advancing (travelling) direction of the recording medium. Specifically, the rotary portion rocks such that the central axis direction of the rotary portion becomes same as or similar to a direction orthogonal to the advancing direction of the recording medium. Accordingly, it is possible to suppress the increase in rotational load on the rotary portion. As a result, it is possible to suppress the occurrence of jam of the recording medium and/or to suppress the slip of the rotary portion with respect to the recording medium. In a case that the slip of the rotary portion with respect to the recording medium is suppressed, it is possible to suppress any disturbance in the image recorded on the recording medium.

According to another aspect of the present teaching, there is provided a recording apparatus including: a recording unit configured to record an image on a recording medium; and a transporting path via which the recording medium, having the image recorded thereon by the recording unit, is transported in a predetermined direction; a guide which is arranged at an end portion of the transporting path, the end portion being an end in a width direction orthogonal to the predetermined direction, and which is configured to restrict movement of the recording medium in the width direction; and a pair of rollers arranged between the guide and a central portion in the width direction of the transporting path, the pair of rollers including a driving roller configured to move the recording medium in the predetermined direction, and a driven roller arranged to face the driving roller and configured to rotate according to rotation of the driving roller or movement of the recording medium, wherein the driven roller includes a shaft, and a rotary portion attached to the shaft so as to rotate in a circumferential direction of the shaft; and a rotational center axis of the rotary portion is movable with respect to a center axis of the shaft.

BRIEF DESCRIPTION OF THE DRAWINGS

FIGS. 4A to 4D show states (situations) of an operation for positioning paper (paper sheet, sheet) by the positioning mechanism, wherein FIG. 4A shows the state of operation before the pair of rollers transports the sheet; FIG. 4B shows the states of the spur roller and the advancing direction of the sheet until the sheet transported by the pair of rollers is brought into contact with the boundary line; FIG. 4C shows the state of operation after the sheet has been brought into contact with the boundary line and until the forward end portion of the sheet in the advancing direction of the sheet is brought into contact with a guide surface; and FIG. 4D shows the states of the spur roller and the advancing direction of the sheet after the forward end portion of the sheet in the advancing direction has been brought into contact with the guide surface.

FIGS. 5A and 5B shows a modification of the positioning mechanism according to the present teaching, wherein FIG. 5A is a plane view showing the major components of the positioning mechanism, and FIG. 5B is a cross-sectional view of the spur roller as cutting the spur roller in the axis direction thereof.

FIGS. 6A to 6D show states (situations) of an operation for positioning sheet by the positioning mechanism shown in FIGS. 5A and 5B, wherein FIG. 6A shows the state of the spur roller before the pair of rollers transports the sheet; FIG. 6B shows the states of the spur roller and the advancing direction of the sheet until the sheet transported by the pair of rollers is brought into contact with the boundary line; FIG. 6C shows the state of operation after the sheet has been brought into contact with the boundary line and until the forward end portion of the sheet in the advancing direction of the sheet is brought into contact with a guide surface; and FIG. 6D shows the states of the spur roller and the advancing direction of the sheet after the forward end portion of the sheet in the advancing direction has been brought into contact with the guide surface.

DESCRIPTION OF THE PREFERRED EMBODIMENTS

In the following, a preferred embodiment of the present teaching will be explained with reference to the drawings.

Figure 1:
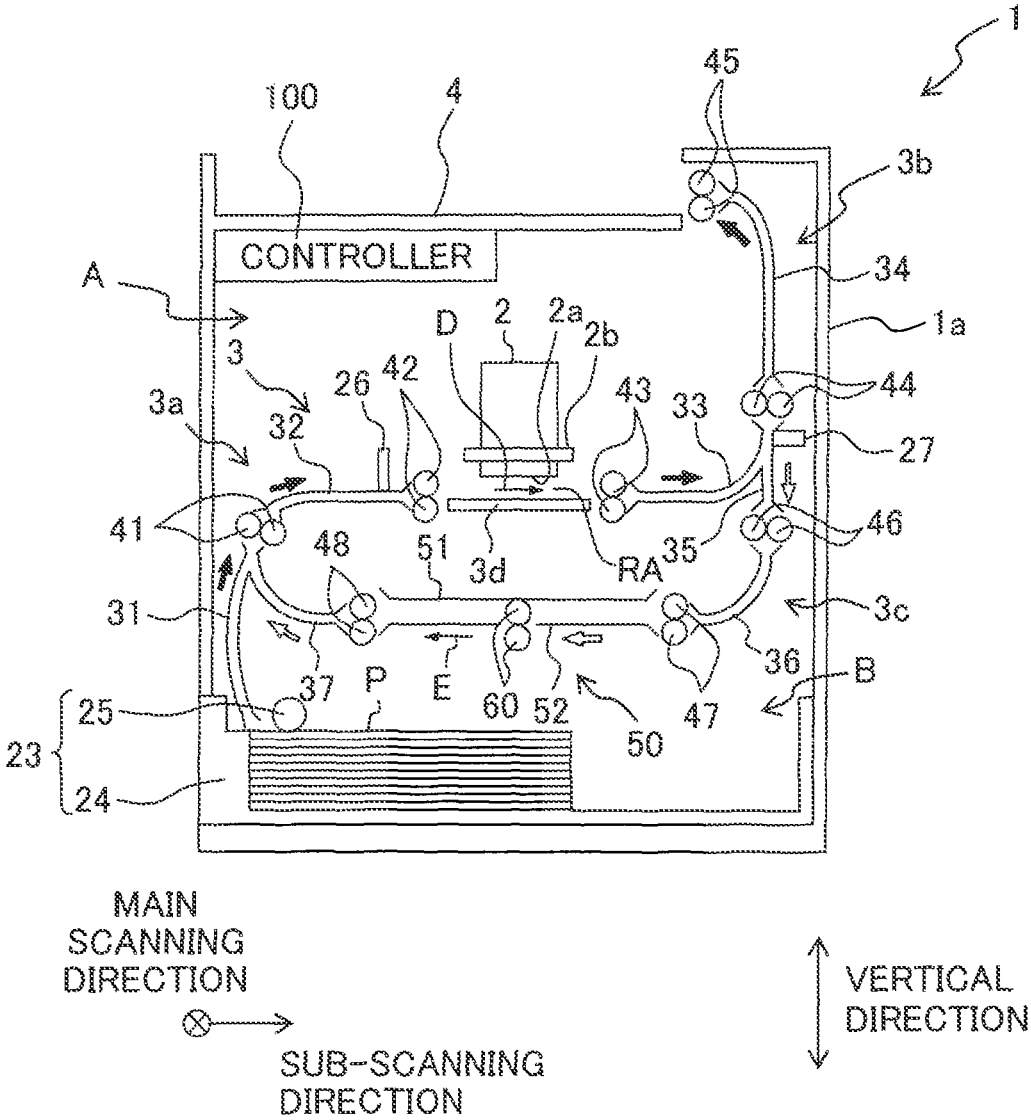
FIG. 1 is a schematic side view showing the inner configuration of an ink-jet printer as an embodiment of the recording apparatus of the present teaching.

First, explanation will be given about the overall configuration of an ink-jet printer (printer) 1 as an embodiment of the recording apparatus according to the present teaching, with reference to FIG. 1.

The printer 1 has a casing 1*a* which has a rectangular shape. A sheet discharge section 4 is provided on the upper surface of the top plate of the casing 1*a*. The inner space of the casing 1*a* can be segmented into, from top to bottom, space A and space B in this order. A sheet transporting path extending from a sheet feeding section 23 toward the sheet discharging section 4 and a sheet re-transporting path different from the sheet transporting path and extending from the downstream side toward the upstream side of the sheet transporting path are formed in the spaces A and B. As shown in FIG. 1, a paper sheet (sheet) P is transported in the sheet transporting path along black thick arrows, and the sheet is transported in the sheet re-transporting path along thick outline arrows. In the space A, recording of an image on the sheet P, transportation of the sheet P to the sheet discharging section 4, and re-transportation of the sheet P via the re-transporting path is performed. Note that the term "re-transportation of the sheet P" means transporting and returning the sheet, which has been transported to the downstream side of the transporting path, again to the upstream side of the transporting path. In the space B, the sheet is fed from the sheet feeding section 23 to the sheet transporting path.

A head (recording unit) 2 which discharges an ink such as a black ink, etc., a transporting device 3, a controller 100, etc. are arranged in the space A. A non-illustrated cartridge is also installed in the space A. The cartridge stores the ink therein. The cartridge is connected to the head 2 via a tube and a pump (both of which are not shown in the drawing), and the ink is supplied from the cartridge to the head 2 via the tube and the pump.

The head 2 is a line-type head having substantially rectangular shape elongated in a main scanning direction (a direction orthogonal to the transporting direction of the sheet P in the sheet transporting path). The lower surface of the head 2 is a discharge surface 2*a* in which a large number of discharge ports are open. When performing recording an image on the sheet P, the ink is discharged from the discharge surface 2*a*. The head 2 is supported by the casing 1*a* via a head holder 2*b*. The head holder 2*b* holds the head 2 such that a predetermined gap suitable for the recording is defined between the discharge surface 2*a* and a platen 3*d* (to be described later on).

The transporting device 3 has an upstream guide portion 3*a*, a downstream guide portion 3*b*, re-transporting guide portion 3*c* and the platen 3*d*. The platen 3*d* is arranged at a position facing or opposite to the discharge surface 2*a* of the head 2. The platen 3*d* has a flat upper surface, supports the sheet P from below, and defines a recoding area RA between the platen 3*d* and the discharge surface 2*a*. The recording area RA is a portion of the sheet transporting path. The upstream guide portion 3*a* and the downstream guide portion 3*b* are arranged to sandwich the platen 3*d* therebetween in the sheet transporting path. The upstream guide portion 3*a* has two guides 31 and 32, two pairs of transporting rollers 41 and 42, and connects the recording area RA and the sheet feeding section 23. The downstream guide portion 3*b* has two guides 33 and 34 and three pairs of transporting rollers 43, 44 and 45, and connects the recording area RA and the sheet discharge section 4. The sheet transporting path is defined by the four guides 31 to 34, the platen 3*d* and the head 2.

The re-transporting guide portion (transporting mechanism) 3*c* has three guides 35, 36 and 37, three pairs of transporting rollers 46, 47 and 48 and a positioning mechanism 50. The re-transporting guide portion 3*c* connects the upstream guide portion 3*a* and the downstream guide portion 3*b* while bypassing the recording area RA. The guide 35 is connected to an intermediate portion of the guide 33, and connects the re-transporting guide portion 3*c* and the downstream guide portion 3*b*. The guide 37 is connected to an intermediate portion of the guide 31, and connects the re-transporting guide portion 3*c* and the upstream guide portion 3*a*. The sheet re-transporting path is defined by the three guides 35 to 37 and the positioning mechanism 50.

Note that the transporting direction in which the sheet P is transported can be switched by controlling the rotational direction of the pair of transporting rollers 44 by the controller 100. In a case of transporting the sheet P from the recording area RA to the sheet discharging section 4, the pair of transporting rollers 44 is rotated such that the sheet P is transported upwardly. On the other hand, in a case of transporting the sheet P from the sheet transporting path to the sheet re-transporting path, the rotational direction of the pair of transporting rollers 44 is switched when the rear end of the sheet P, the rear end being positioned at the rear side in the advancing direction of the sheet P, is positioned between the pair of transporting rollers 44 and the connecting portion of the guide 33 and the guide 35, and when the rear end is detected by a sheet sensor 27. By doing so, the sheet P is transported downwardly, with an end of the sheet P which has been the rear side in the advancing direction becoming now the forward (leading) end in the downward transportation. The sheet P, which has been transported from the sheet transporting path to the sheet re-transporting path, is re-transported to the upper guide portion 3*a*. At this time, the sheet P which is being re-transported is transported again to the recording area RA in a state that the upper and lower surfaces of the sheet is reversed from the state when the sheet P has passed through the recording area RA preceding the re-transportation. With this, images can be printed on the both sides of the sheet P.

The three pairs of transporting rollers 46, 47 and 48 are arranged in this order along the transporting direction of the sheet P in the sheet re-transporting path (in the direction of the thick outline arrows in FIG. 1), and the positioning mechanism 50 is arranged between the pair of transporting rollers 47 and the pair of transporting rollers 48. Further, the positioning mechanism 50 is arranged between the recording area RA and the sheet feeding section 23, namely between the platen 3*d* and the sheet feeding section 23, with respect to the vertical direction. The positioning mechanism 50 has an upper guide 51, a lower guide 52, and a pair of rollers 60. Further, the positioning mechanism 50 performs positioning of the sheet P, which has been transported to the area between the upper and lower guides 51 and 52, in the width direction of the sheet P by transporting the sheet P while bringing one end in width direction of the sheet P into contact with a guide surface 54*a* (to be described later on). Here, the width direction of the sheet P is a main scanning direction, namely a direction orthogonal to a transporting direction E in which the sheet P is transported (FIG. 1). The specifics of the positioning mechanism 50 will be described later on.

The sheet feeding section 23 is arranged in the space B. The sheet feeding section 23 has a sheet feeding tray 24 and a sheet feeding roller 25 among which the Sheet feeding tray 24 is detachably attached with respect to the casing 1*a*. The sheet feeding tray 24 is a box-shaped member which is open upwardly, and is capable of storing a plurality of numbers of sheet P (plurality of paper sheets P) therein. The sheet feeding roller 25 feeds out a sheet P, which is located at the uppermost position inside the sheet feeding tray 24, to the sheet transporting path.

Here, a "sub-scanning direction" is a direction parallel to a sheet-transporting direction D as a direction in which the sheet P is transported by the pair of transporting rollers 42 and the pair of transporting rollers 43 and the sheet-transporting direction E as a direction in which the sheet P is transported by the pair of transporting rollers 47 and the pair of transporting rollers 48. The main scanning direction is a direction parallel to a horizontal plane and is orthogonal to the sub-scanning direction.

Next, the controller 100 will be explained. The controller 100 controls the operations of the respective components or parts of the printer 1 to thereby manage the operation of the printer 1 as a whole. The controller 100 controls a recording operation for recording an image on a sheet P, based on a recording command or instruction supplied from an external apparatus (personal computer connected to the printer 1, etc.). Specifically, the controller 100 controls, for example, a sheet transporting operation of the sheet P and an ink discharging operation synchronized with the transportation of the sheet P.

For example, in a case that the controller 100 receives, from the external apparatus, a recording command to perform recording on one side (one surface) of the sheet P, the controller 100 drives the sheet feeding section 23, the pairs of transporting rollers 41 to 45 based on the recording command. The sheet P, fed out from the sheet feeding tray 24, is guided by the upstream guide portion 3*a* and is transported to the recording area RA. When the sheet P passes an area immediately below the head 2, the head 2 is controlled by the controller 100 and ink droplets are discharged from the head 2 toward the sheet P. With this, a desired image is recorded on a surface of the sheet P. The ink discharging operation (ink discharge timing) is based on a detection signal from a sheet sensor 26 which is arranged at a location on the upstream side of the head 2 in the transporting direction and which detects the forward end of the sheet P, the forward end being positioned at the forward side in the advancing direction of the sheet P, at this location. The sheet P having the image recorded thereon is guided by the downstream guide portion 3*b* and is discharged to the sheet discharge section 4 from the upper portion of the casing a.

On the other hand, for example, in a case that the controller 100 receives, from the external apparatus, a recording command to perform recording on both sides (both surfaces) of the sheet P, the controller 100 drives the sheet feeding section 23, the pairs of transporting rollers 41 to 45 based on this recording command. At first, an image is formed on a surface of the sheet P in a similar manner as the recording operation described above, and the sheet P having the image formed on one surface thereof is transported toward the sheet discharge section 4. As shown in FIG. 1, in the guide portion 3*b* as the transporting path, the sheet sensor 27 is arranged upstream of and in the vicinity of the pair of transporting rollers 44. When the sheet sensor 27 detects the rear end in the transporting direction of the sheet P, then the rotational direction of the pair of transporting rollers 44 is controlled by the controller 100 to be reversed, and the transporting direction of the sheet P is reversed. At this time, the pairs of transporting rollers 46 to 48 and the pair of rollers 60 are also driven. With this, the advancing direction and the transporting path for the sheet P are switched, and the sheet P is transported along the sheet re-transporting path (path indicated by thick outline arrows shown in FIG. 1). At this time, the sheet P is positioned with respect to the main scanning direction by the positioning mechanism 50, and the sheet P for which the positioning has been performed is re-transported to the recording area RA. The sheet P which has been re-transported from the sheet re-transporting path to the upper guide portion 3*a* is supplied again to the recording area RA in an upside down state relative to the state when the sheet P has passed through the recording area RA preceding the re-transportation, and an image is recorded on the back side (a surface on which no image has been previously recorded) of the sheet P. Note that prior to the image recording on the back side of the sheet P, when the forward end portion in the advancing direction of the sheet P is detected by the sheet sensor 26, the rotation of the pair of transporting rollers 44 is returned from the reverse rotation to the normal rotation (rotation for transporting the sheet P toward the sheet discharging section 4). With this, the sheet P, having the images printed on the both sides respectively, is then discharged to the sheet discharging section 4 via the downstream guide portion 3*b*.

Figure 2:
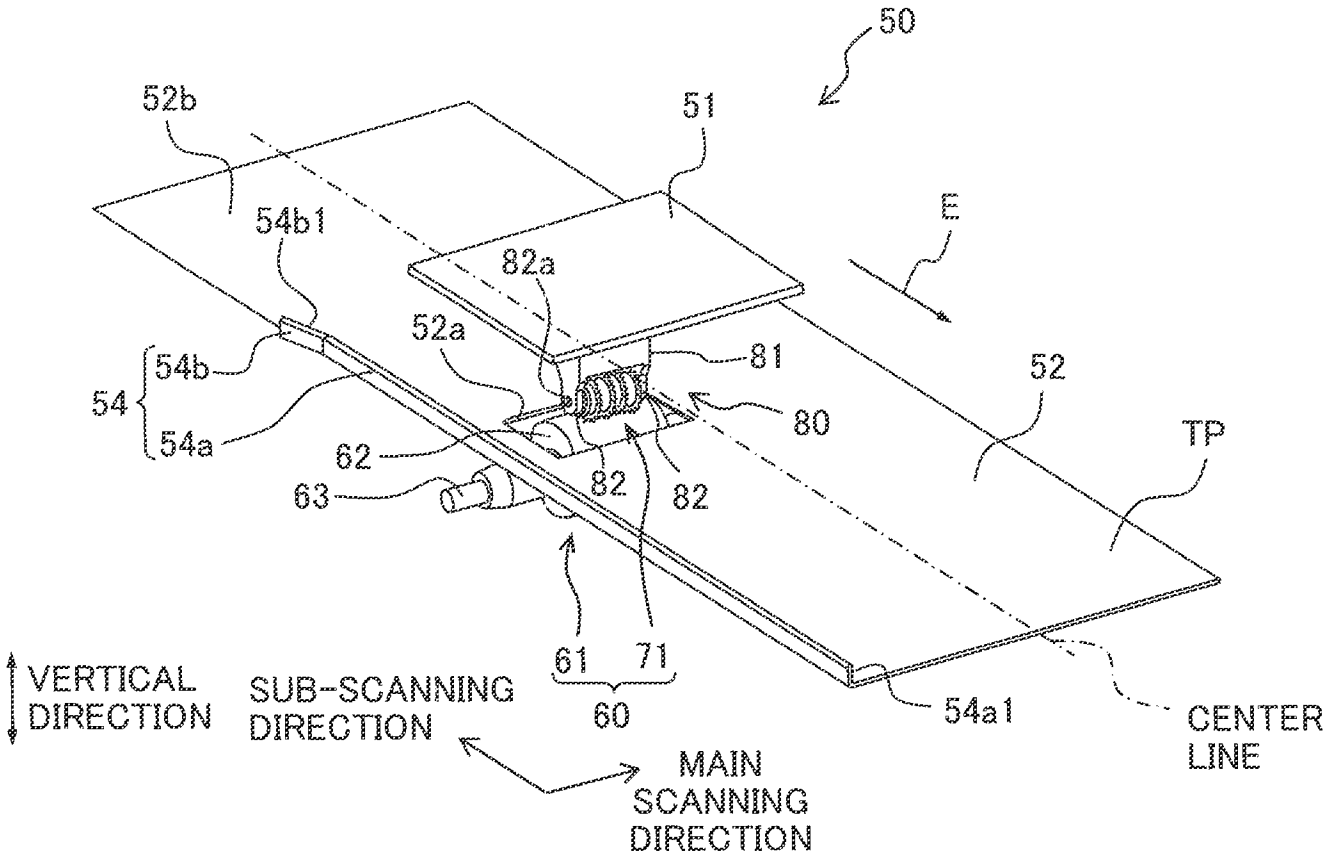
FIG. 2 is a schematic perspective view of a positioning mechanism shown in FIG. 1.
Figure 3A:
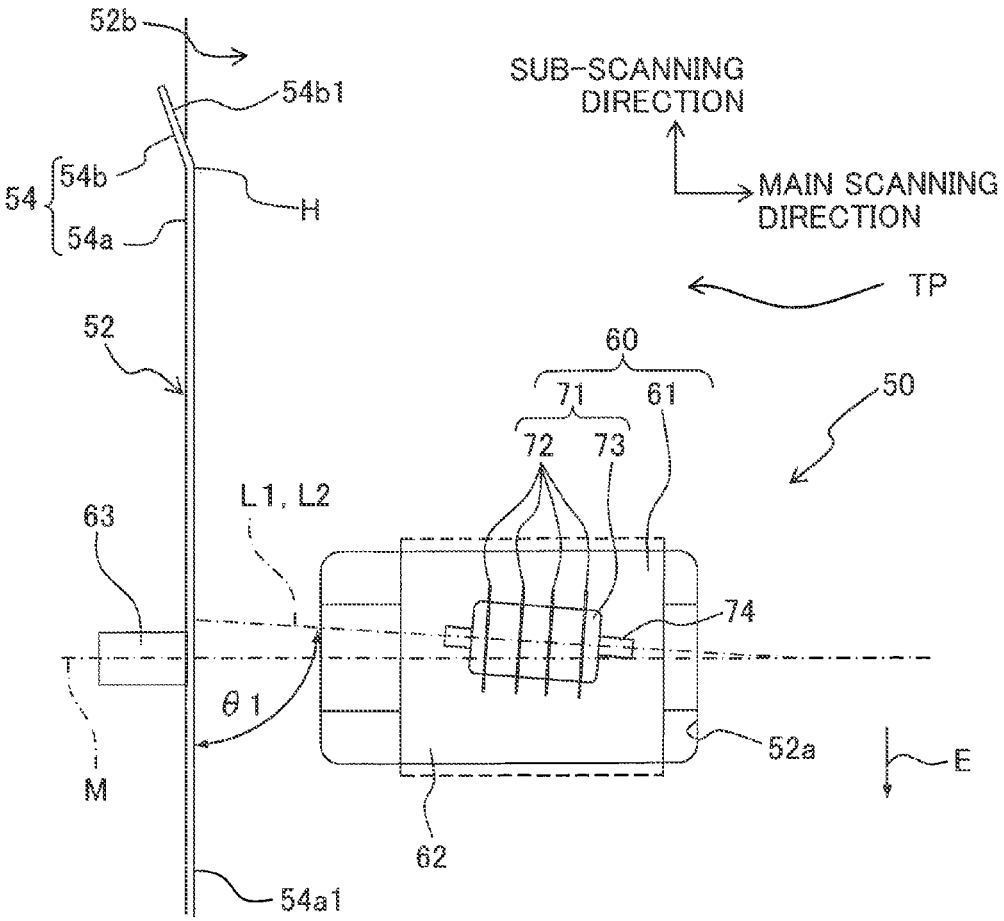
FIG. 3A is a plane view showing the major components of the positioning mechanism.

Next, the positioning mechanism 50 will be explained in detail with reference to FIGS. 2 and 3. As shown in FIG. 2, the upper guide 51 and the lower guide 52 of the positioning mechanism 50 are each a plate-shaped member and are arranged apart from each other in the vertical direction. The space between the upper and lower guides 51 and 52 constitutes a portion of the sheet re-transporting path (transporting path TP). A hole 52*a* is formed in the lower guide 52 to penetrate the lower guide 52 in the thickness direction. As shown in FIG. 3A, the hole 52*a* has a plane size (size in the sub-scanning direction) slightly smaller than that of a driving roller 61 (to be described later on). The lower guide 52 has a transportation surface 52*b* supporting the lower surface of the sheet P which has been transported to the lower guide 52. An upright portion 54, rising upright in the vertical direction, is formed in the lower guide 52 at one end portion thereof in the main scanning direction. The upright portion 54 has an extending portion 54*a* extending along the sub-scanning direction and a tapered portion 54*b*. The extending portion 54*a* has a guide surface 54*a*1 that is a vertical plane including the sub-scanning direction in in-plane directions thereof. The guide surface 54*a*1 is composed of a side surface of the extending portion 54*a*, the side surface being defined on the side of the pair of rollers 60. The tapered portion 54*b* is connected to an upstream end portion of the extending portion 54*a* located on the upstream side in the transporting direction E. The tapered portion 54*b* has a tapered surface 54*b*1 which is a vertical plane intersecting with the guide surface 54*a*1. The tapered surface 54*b*1 is composed of a side surface, of the tapered portion 54*b*, on the side of the pair of rollers 60, namely the side surface continued to the guide surface 54*a*1. Note that, regarding the upper guide 51, only a portion thereof is shown in FIG. 2.

The pair of rollers 60 is composed of a driving roller 61 and a spur roller 71 facing the driving roller 61. The pair of rollers 60 is arranged at the transporting path TP between the upper and lower guides 51 and 52 and at a position closer to the guide surface 54*a*1 than a central portion in the main scanning direction (the center line indicated by a dashed line in FIG. 2) of the transporting path TP, that is a position between the guide surface 54*a*1 and the central portion in the main scanning direction of the transporting path TP. The spur roller 71 is a driven roller which rotates following the rotation of the driving roller 61 or the movement of the sheet P transported by the driving roller 61.

As shown in FIG. 2, the driving roller 61 has a roller body 62 having a cylindrical shape and a shaft portion 63 which rotates together with the roller body 62. The roller body 62 is arranged at a position facing the hole 52*a* to be located lower than the spur roller 71. The roller body 62 is arranged such that an upper end portion of the roller body 62 projects, through the hole 52*a*, upwardly to a slight extent than the transportation surface 52*b* of the lower guide 52. Thus, the roller body 62 makes contact with the lower surface of the sheet P which has been transported on the transportation surface 52*b* to the roller body 62. The shaft portion (second shaft portion) 63 is fixed to the roller body 62 in a state that the shaft portion 63 is inserted through the roller body 62, and constitutes the rotation axis of the driving roller 61. The shaft portion 63 is rotatably supported by the casing 1*a*. The positioning mechanism 50 has a driving mechanism (not shown), and the driving mechanism includes, for example, a non-illustrated driving motor, a non-illustrated gear transmitting the rotational force from the driving motor, and the like. The driving mechanism is controlled and driven by the controller 100, and causes the roller body 62 to rotate via the shaft portion 63. The driving roller 61 is arranged such that an axis line M of the shaft portion 63 is parallel to the main scanning direction. Namely, the driving roller 61 is arranged such that the axis line M of the shaft portion 63 is orthogonal to the guide surface 54*a*1. With this, the configuration of the driving mechanism is simplified. If the axis line M of the shaft portion 63 intersects with the main scanning direction, namely, if the axis line M of the shaft portion 63 is arranged to be inclined with respect to the main scanning direction, then there is a need to adjust the components or parts, such as a gear of the driving mechanism, to this inclination, which in turn complicates the configuration of the driving mechanism.

Further, the positioning mechanism 50 has a roller supporting portion 80 which supports the spur roller 71. The roller supporting portion 80 has a body 81 and an urging portion (not shown in the drawing) which urges the body 81 downwardly. The body 81 is attached to the lower surface of the upper guide 51 via the urging portion. A pair of flanges 82 projecting downwardly is formed on the lower surface of the body 81. Holes 82*a* are formed in the pair of flanges 82. A shaft portion 74 of the spur roller 71 is inserted into the holes 82*a* to thereby support the spur roller 71 rotatably with respect to the roller supporting portion 80. The urging portion is composed of an elastic member such as a coil spring, and urges the spur roller 71 and the body 81 toward the driving roller 61 (downwardly). With this, a predetermined nipping three for nipping or pinching the sheet P is generated between the spur roller 71 and the driving roller 61. Accordingly, the sheet P becomes hard to slip with respect to the driving roller 61 and the sheet P is suitably transported in the transporting direction E.

Figure 3B:
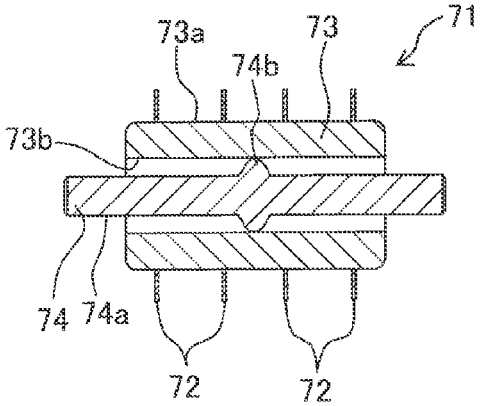
FIG. 3B is a cross-sectional view of a spur roller as cutting the spur roller in the axis direction thereof.
Figure 3C:
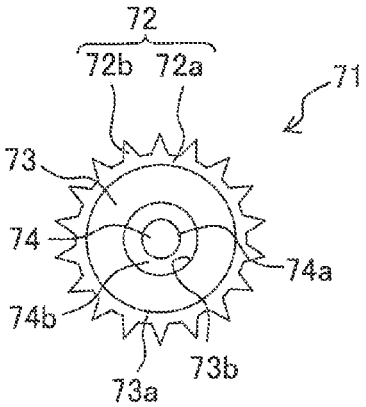
FIG. 3C is a side view of the spur roller, as seen from the axis direction of the spur roller.

As shown in FIG. 3, the spur roller 71 has four spurs 72, a roller body 73 having a cylindrical shape, and a shaft portion 74 which is inserted through the roller body 73 and which supports the roller body 73 to be rotatable in the circumferential direction of the shaft portion 74. The spur roller 71 is arranged at a position overlapping with the guide surface 54*a*1 with respect to the transporting direction E. As shown in FIG. 3C, each of the spurs 72 is a thin plate-shaped member which has an annular-shaped portion 72*a* fixed to an outer circumferential surface 73*a* of the roller body 73, and a plurality of projections 72*b* projecting outwardly from the annular-shaped portion 72*a*. The projections 72*b* each has a tapered shape. Pointed tip portions of the projections 72*b* are brought into contact with the sheet P as if sticking the sheet P, which in turn allows the spur roller 71 to rotate following the movement of the sheet P.

As shown in FIG. 3A, the shaft portion 74 is arranged such that an angle θ1, defined by an axis line L1 of the shaft portion 74 and a portion of the guide surface 54*a*1, the portion being located in the transporting direction E on the downstream side of the intersection of the axis line L1 and the guide surface 54*a*1, becomes an acute angle. The acute angle in the preceding sentence can be, for example, an angle in a range of 85 degrees to 89 degrees, and preferably an angle of 88 degrees. Further, as shown in FIG. 3B, the shaft portion 74 has a projection 74*b* having an annular shape and projecting from an outer circumferential surface 74*a* of the shaft portion 74 in the radial direction. The projection 74*b* is formed in the shaft portion 74 at a central portion in the extending direction (axis direction) of the shaft portion 74. Further, the projection 74*b* is formed to have such an outer diameter slightly smaller than the inner diameter of the roller body 73 to the degree that the shaft portion 74 can be inserted through the roller body 73. Furthermore, the shaft portion 74 is arranged such that the tip portion of the projection 74*b* makes contact with the central portion (central portion in the extending direction (axis direction) of the roller body 73) of an inner circumferential surface 73*b* of the roller body 73. Accordingly, the distances from the contact portion, at which the roller body 73 makes contact with the projection 74*b* of the shaft portion 74, to the both end portions in the extending direction of the roller body 73 are same with each other. The tip portion of the projection 74*b* makes contact with the inner circumferential surface 73*b* of the roller body 73 to provide the contact portion which serves as the rocking center of rocking motion of the roller body 73 with respect to the shaft portion 74. With this configuration, the end portions in the extending direction of the roller body 73 are made to be capable of rocking in the diametrical direction, using the tip portion of the projection 74*b* as the rocking center, in a range until the inner circumferential surface 73*b* of the roller body 73 makes contact with the outer circumferential surface 74*a* of the shaft portion 74. More specifically, the end portions in the extending direction of the roller body 73 are made to be capable of rocking in the diametrical directions of the roller body 73 and the shaft portion 74, using the tip portion of the projection 74*b* as the rocking center, in a range in which the inner circumferential surface 73*b* of the roller body 73 does not make contact with the outer circumferential surface 74*a* of the shaft portion 74, at each of the end portions of the roller body 73 in the extending direction of the roller body 73. Further in other words, the roller body 73 is supported by the shaft portion 74 such that an axis line L2 of the roller body 73 is intersectable (crossable) with respect to the axis line L1 of the shaft portion 74 and that the intersecting state of the axis line L2 and the axis line L1 is changeable (variable) by the rocking motion of the roller body 73 relative to the shaft portion 74. As a result, the spur roller 71 (roller body 73) rocks (shifts) in accordance with the advancing direction of the sheet P and thus is capable of following the change in the advancing direction of the sheet P to thereby change its rotational direction.

Next, an explanation will be given about the positioning operation for positioning sheet P by the positioning mechanism 50 as follows, with reference to FIGS. 4A to 4D.

Figure 4A:
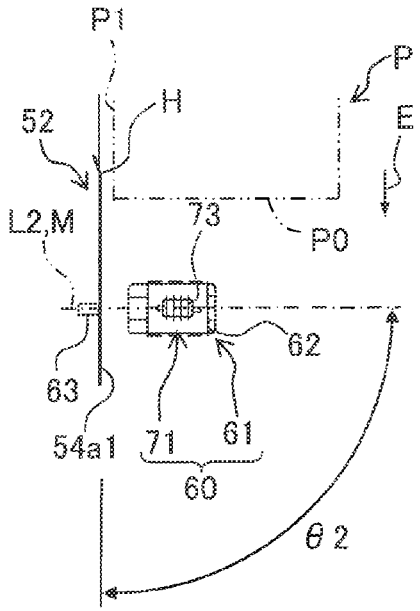

A sheet P is transported to the positioning mechanism 50 by the pair of transporting rollers 47. At a point of time before a side P0 located at the forward side in the advancing direction of the sheet P arrives at the pair of rollers 60, the spur roller 71 is rotating following the rotation of the driving roller 61. Therefore, the roller body 73 rocks with respect to the shaft portion 74 such that the axis line L2 of the roller body 73 is parallel to the axis line M of the shaft portion 63 of the driving roller 61, as shown in FIG. 4A. Namely, the roller body 73 is arranged such that an angle θ2 defined by the axis line L2 and a portion of the guide surface 54*a*1, the portion being located in the transporting direction E on the downstream side of the intersection of the guide surface 54*a*1 and the axis line L2 becomes an angle of approximately 90 degrees (right angle). With this, at the contact point of the driving roller 61 and the spur roller 71, the rotational direction of the roller body 73 and the spurs 72 is approximately same with the rotational direction of the roller body 62 of the driving roller 61. As a result, in the spur roller 71, the rotational load due to the rotational force received from the driving roller 61 becomes small. Namely, the driving roller 61 can rotate the spur roller 71 under a smaller load.

Figure 4B:
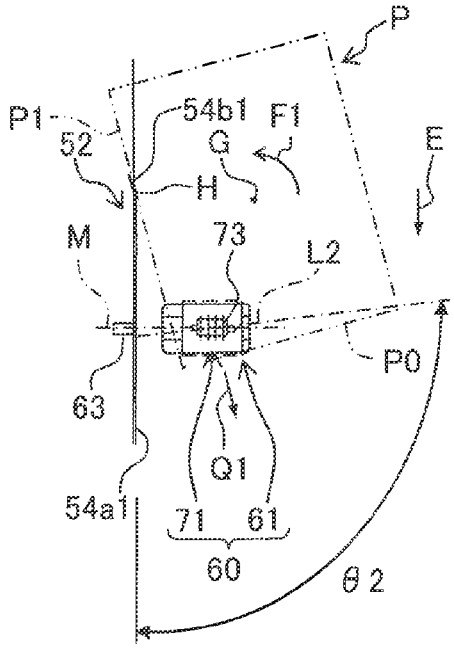

When the side P0 of the sheet P reaches the pair of rollers 60, the sheet P is pinched (nipped, held) by the pair of rollers 60 and is transported thereby. At this time, as shown in FIG. 4B, the pair of rollers 60 transports a left-side portion of the sheet P in FIG. 4B, and thus a rotational moment in the counterclockwise direction in FIG. 4B is generated in the sheet P, with a center of gravity G of the sheet P as the center of rotation. As a result, the sheet P is transported in the transporting direction E by the driving roller 61, while rotating in a rotational direction F1 with the center of gravity G as the center of rotation until a side P1 of the sheet P on the side of the guide surface 54*a*1 is brought into contact with (abuts against) a boundary line H between the guide surface 54*a*1 and the tapered surface 54*b*1. Further, at this time, since the spur roller 71 is brought into contact with the sheet P and is rotated following the movement of the sheet P, the roller body 73 rocks with respect to the shaft portion 74 in accordance with an advancing direction Q1 of the sheet P at the contact point between the spur roller 72 and the sheet P, namely in accordance with a resultant direction obtained by combining the rotational direction F1 and the transporting direction E. Specifically, the roller body 73 rocks such that the direction of the axis line L2 (central axis direction) of the roller body 73 becomes same as or similar to the direction orthogonal to the advancing direction Q1 of the sheet P. Namely, the roller body 73 is arranged such that the angle θ2 is an obtuse angle. Thus, at the contact point between the spur roller 71 and the sheet P, the rotational directions of the roller body 73 and the spurs 72 become same as or similar to the advancing direction Q1 of the sheet P. As a result, in the spur roller 71, the rotational load due to the rotational three received from the sheet P becomes small. Namely, the driving roller 61 can rotate the spur roller 71 under a smaller load, via the sheet P.

In this case, the spur roller 71 is arranged such that the angle θ1 is an acute angle. If the spur roller 71 is arranged such that the angle θ1 is an angle of not less than 90 degrees, then the maximum value of the angle θ2 when the side P1 of the sheet P is brought into contact with the boundary line H is greater than the case wherein the angle θ1 is an acute angle. Accordingly, the sheet P is easily separated away from the guide surface 54*a*1. In the embodiment, however, since the spur roller 71 is arranged such that the angle θ1 is an acute angle, the maximum value of the angle θ2 is small and the sheet P is hard to be transported in a direction separated away from the guide surface 54*a*1.

Figure 4C:
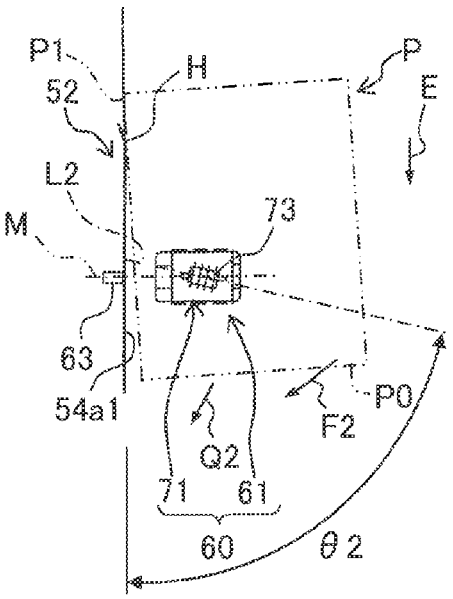

In a case that the sheet P is transported by the pair of rollers 60 in a state that the side P1 of sheet P is brought into contact with the boundary line H, as shown in FIG. 4C, the rotational moment in the clockwise direction in FIG. 4C is generated in the sheet P, with the boundary line H as the center of rotation. As a result, the sheet P is transported in the transporting direction E by the driving roller 61, while rotating in a rotational direction F2 with the boundary line H as the center of rotation until the side P0 of the sheet P (connection portion between the sides P0 and P1) is brought into contact with (abuts against) the guide surface 54*a*1. Further, at this time, the roller body 73 rocks with respect to the shaft portion 74 following an advancing direction Q2 of the sheet P at the contact point between the spur roller 72 and the sheet P, namely following a resultant direction obtained by combining the rotational direction F2 and the transporting direction E. Specifically, the roller body 73 rocks such that the direction of the axis line L2 of the roller body 73 becomes same as or similar to the direction orthogonal to the advancing direction Q2 of the sheet P. Namely, the roller body 73 is arranged such that the angle θ2 is an acute angle. Thus, at the contact point between the spur roller 71 and the sheet P, the rotational directions of the roller body 73 and the spurs 72 become same as or similar to the advancing direction Q2 of the sheet P. As a result, in the spur roller 71, the rotational load due to the rotational force received from the sheet P becomes small. Namely, the driving roller 61 can rotate the spur roller 71 under a smaller load, via the sheet P.

Figure 4D:
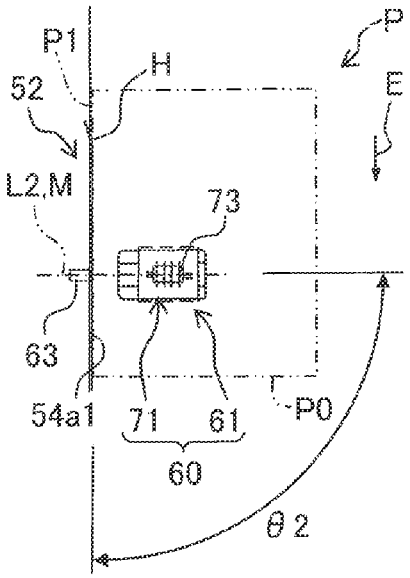
Figure 4D:
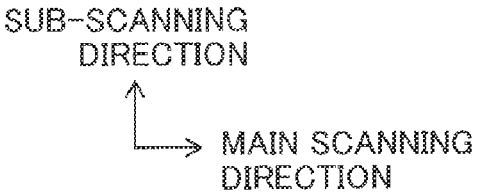

As shown in FIG. 4D, when the side P0 of the sheet P is brought into contact with the guide surface 54*a*1, substantial portion of the side P1 is brought into contact with the guide surface 54*a*1. Therefore, the advancing direction of the sheet P transported by the pair of rollers 60 is same with the transporting direction E. Further, at this time, the roller body 73 rocks following the advancing direction of the sheet P (transporting direction E) and is arranged such that the axis line L2 and the axis line M are parallel to each other. Namely, the roller body 73 is arranged such that the angle θ2 is angle of approximately 90 degrees (right angle). Accordingly, at the contact point between the spur roller 71 and the sheet P, the rotational direction of the roller body 73 and the spur roller 72 is approximately same as the advancing direction of the sheet P (transporting direction E). As a result, in the spur roller 71, the rotational load due to the rotational force received from the sheet P becomes small. Namely, the driving roller 61 can rotate the spur roller 71 under a smaller load, via the sheet P. In the manner as described above, it is possible to position the sheet P in the main scanning direction. In this state, the sheet P is transported in the transporting direction E in the state in which the side P1 of the sheet P is in contact with the entire guide surface 54*a*1.

As described above, according to the printer 1 of the embodiment, the skew correction (the positioning) is performed by using the configuration wherein the pair of rollers 60 is arranged at the position closer to the guide surface 54*a*1 than the center (center line) of the transporting path TP (a position between the guide surface 54*a*1 and the central portion in the main scanning direction of the transporting path TP), to thereby transport the sheet P along the guide surface 54*a*1. In this situation, since the roller body 73 is supported such that the roller body 73 is capable of rocking with respect to the shaft portion 74, the roller body 73 rocks in accordance with the advancing direction of the sheet P. Specifically, the roller body 73 rocks such that the direction of the axis line L2 of the roller body 73 becomes same as or similar to the direction orthogonal to the advancing direction of the sheet P. Accordingly, it is possible to suppress the increase in rotational load on the roller body 73. In other words, the roller body 73 can be rotated under a smaller load. As a result, it is possible to suppress the occurrence of jam of the sheet P and/or to suppress the occurrence of slip of the spurs 72 with respect to the sheet P. In a case that the slip of the spurs 72 with respect to the sheet P is suppressed, it is possible to suppress any disturbance in the image recorded on the sheet P.

In the printer 1 of the embodiment, the spur roller 71 is arranged at the position overlapping with the guide surface 54*a*1 with respect to the transporting direction E. With this, the sheet P is guided closer to the guide surface 54*a*1 by the pair of rollers 60 in an ensured manner. If the spur roller 71 is located on the upstream or downstream of the guide surface 54*a*1 with respect to the transporting direction E, then the distance through which the sheet P is transported while being brought into contact with the guide surface 54*a*1 becomes short, and it becomes difficult to guide the sheet P sufficiently closer to the guide surface 54*a*1.

In the printer 1 of the embodiment, the projection 74*b*, which serves as the rocking center of the rocking motion of the roller body 73, is formed in the shaft portion 74. Accordingly, it is possible to easily realize the rocking mechanism wherein the roller body 73 rocks with respect to the shaft portion 74. Further, since the spur roller 71 is provided with the four spurs 72, the contact area of the spur roller 71 with respect to the sheet P is small. With this, the image recorded on the sheet P is prevented front being disturbed in a further ensured manner.

Figure 5A:
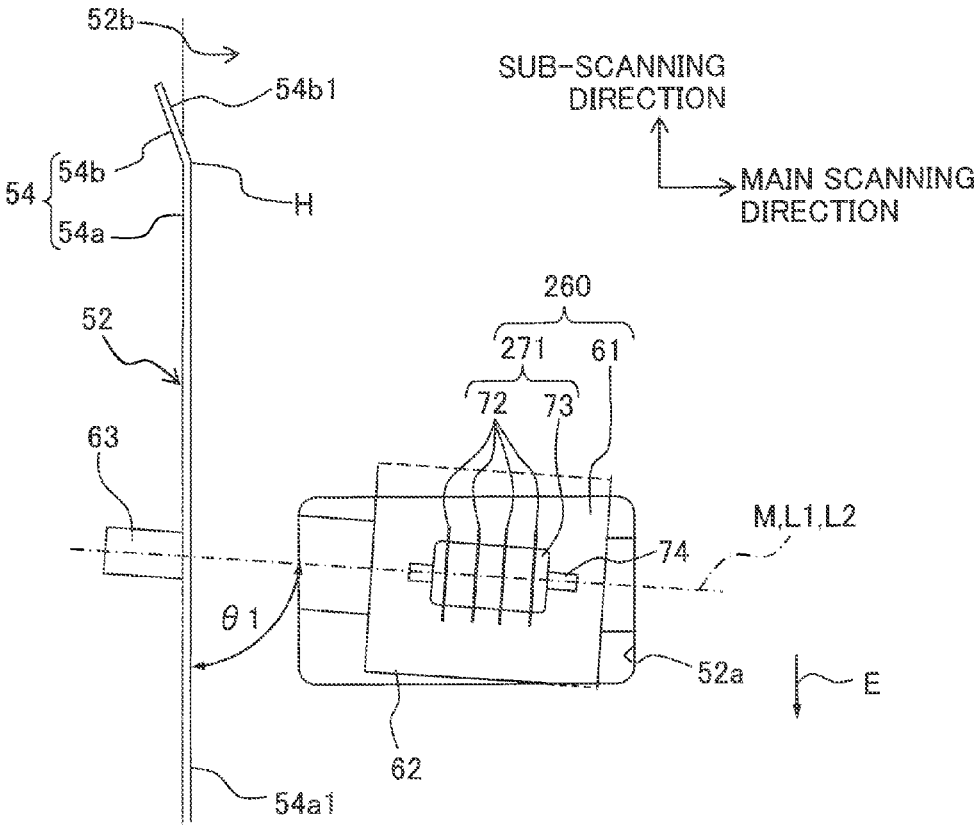

As a modification of the embodiment described above, the driving roller 61 may be arranged as shown in FIG. 5A such that the axis line M of the shaft portion 63 is parallel to the axis line L1 of the shaft portion 74 of the spur roller 71. Specifically, the shaft portion 63 is arranged, as shown in FIG. 5A, such that an angle θ1, defined by the axis line M and a portion of the guide surface 54*a*1, the portion being located in the transporting direction E on the downstream side of the intersection of the axis line NI and the guide surface 54*a*1, is an acute angle. The acute angle in the preceding sentence can be, for example, an angle in a range of 85 degrees to 89 degrees, preferably an angle of 88 degrees. With this, it is possible to further easily guide the sheet P closer to the guide surface 54*a*1.

Figure 5B:
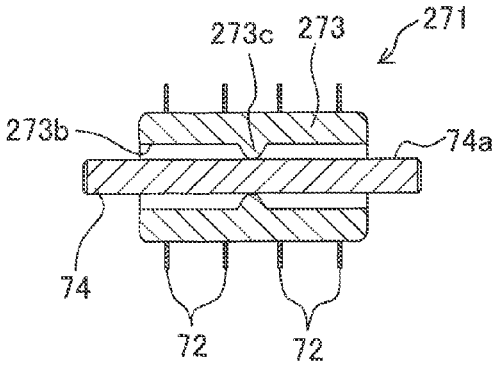

Further, in this modification, as shown in FIG. 5B, a projection 273*c* having an annular shape may be formed on an inner circumferential surface 273*b* of a roller body 273, instead of the projection 74*b* of the shaft portion 74. The projection 273*c* is formed to project from the central portion in the extending direction (axis direction) of the inner circumferential surface 273*b* of the roller body 273 toward the inner side in the radiation direction of the roller body 273. The inner diameter of the projection 273*c* (namely, the diameter of a hole defined by the tip portion of the projection 273*c*) is formed to be slightly greater than the outer diameter of the axis portion 74 of the modification to the degree that the shaft portion 74 can be inserted through the roller body 273, and the tip portion of the projection 273*c* makes contact with the outer circumferential surface 74*a* of the shaft portion 74 to provide the contact portion which serves as the rocking center of the rocking motion of the roller body 273 with respect to the shaft portion 74. With this configuration, the end portions in the extending direction of the roller body 273 are made to be capable of rocking in the diametrical direction, using the tip portion of the projection 273*c* as the rocking center, in a range until the inner circumferential surface 273*b* of the roller body 273 makes contact with the outer circumferential surface 74*a* of the shaft portion 74, in a similar manner as in the above-described embodiment. More specifically, the end portions in the extending direction of the roller body 273 are made to be capable of rocking in the diametrical directions of the roller body 273 and the shaft portion 74, using the tip portion (end portion) of the projection 273*c* as the rocking center, in a range in which the inner circumferential surface 273*b* at each of the end portions in the extending direction of the roller body 273 does not make contact with the outer circumferential surface 74*a* of the shaft portion 74. As a result, the spur roller 271 (roller body 273) rocks in accordance with the advancing direction of the sheet P, and thus, is capable of following the change in the advancing direction of the sheet P to thereby change its rotational direction.

Next, an explanation will be given about the positioning operation for positioning sheet P in this modification as follows, with reference to FIGS. 6A to 6D.

Figure 6A:
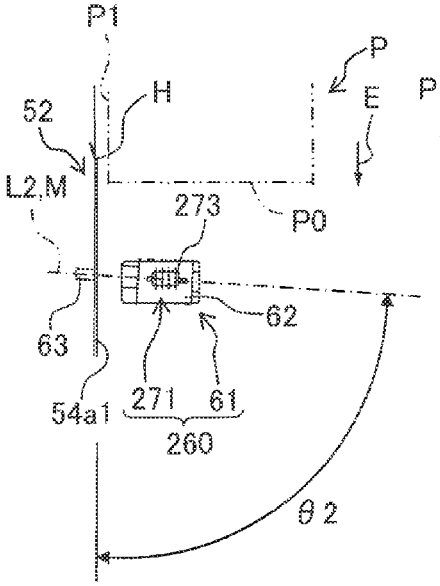
Figure 6B:
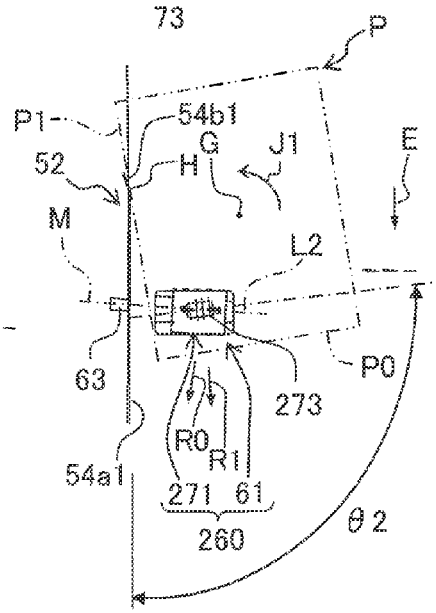

A sheet P is transported to the positioning mechanism 50 by the pair of transporting rollers 47. At a point of time before the side P0 located at the forward side in the advancing direction of the sheet P arrives at a pair of rollers 260, the spur roller 271 is rotating following the rotation of the driving roller 61. Accordingly, the roller body 273 is arranged such that the axis line L2 of the roller body 273 is parallel to the axis line M of the shaft portion 63 of the driving roller 61, as shown in FIG. 6A. Namely, the roller body 273 is arranged such that the angle θ2 is an acute angle. Accordingly, at the contact point of the driving roller 61 and the spur roller 271, the rotational directions of the roller body 273 and the spurs 72 are approximately same with the rotational direction of the roller body 62 of the driving roller 61. As a result, in the spur roller 271, the rotational load due to the rotational force received from the driving roller 61 becomes small. Namely, the driving roller 61 can rotate the spur roller 271 under a smaller load.

When the side P0 of the sheet P reaches the pair of rollers 260, the sheet P is pinched by the pair of rollers 260 and is transported thereby. At this time, the pair of rollers 260 transports a left-side portion of the sheet P in FIG. 6B, and thus the sheet P is rotated in a rotational direction J1 with a center of gravity G of the sheet P as the center of rotation until the side P1 makes contact with (abuts against) the boundary line H, in a similar manner as in the embodiment described above. Further, at this time, the sheet P is transported in a direction R0 approaching closer to the guide surface 54*a*1 (direction orthogonal to the axis line M) by the driving roller 61. In the modification, the driving roller 61 transports the sheet P which is rotating in the rotational direction J1 also in the direction R0 for causing the paper P to approach closer to the guide surface 54*a*1, in the manner as described above. Therefore, in the modification, the time until the sheet P abuts against the boundary linen becomes shorter than in the embodiment described above. As a result, the time required for positioning the sheet P becomes shorter. Furthermore, at this time, since the spur roller 271 is rotated following the movement of the sheet P, the roller body 273 rocks with respect to the shaft portion 74 in accordance with an advancing direction R1 of the sheet P at the contact point between the spurs 72 and the sheet P, namely in accordance with a resultant direction obtained by combining the direction R0 in which the sheet P is transported by the driving roller 61 and the rotational direction J1, such that the direction of the axis line L2 of the roller body 273 becomes same as or similar to the direction orthogonal to the advancing direction R1 of the sheet P in a manner similar to the embodiment described above. Namely, the roller body 273 is arranged such that the angle θ2 is an obtuse angle. With this, it is possible to obtain the effect similar to that obtained in the embodiment described above.

Figure 6C:
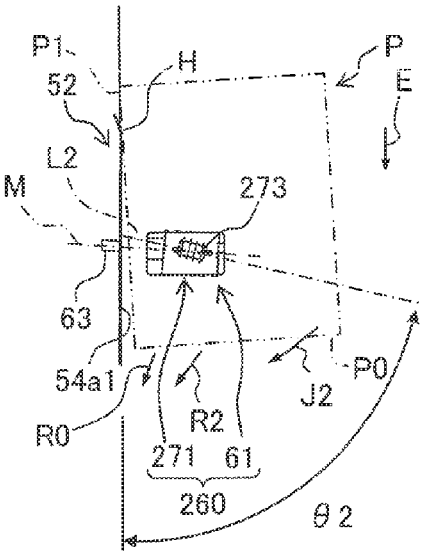

In a case that the sheet P is transported by the pair of rollers 260 in a state that the side P1 of sheet P is brought into contact with the boundary line H, the rotational moment with the boundary line H as the center of rotation is generated in the sheet P, as shown in FIG. 6C. As a result, the sheet P is transported in a direction R0 approaching closer to the guide surface 54*a*1 by the driving roller 61, while rotating in a rotational direction J2 with the boundary line H as the center of rotation until the side P0 of the sheet P (connecting portion between the sides P1 and P0) is brought into contact with (abuts against) the guide surface 54*a*1. Also in this situation, the time until the side P0 of the sheet P abuts against the guide surface 54*a*1 becomes shorter than in the above-described embodiment. As a result, the time required for positioning the sheet P becomes shorter. Further, at this time, the roller body 273 rocks following an advancing direction R2 of the sheet P at the contact point between the spurs 72 and the sheet P, namely following a resultant direction obtained by combining the direction R0 in which the sheet P is transported by the driving roller 61 and the rotational direction J2, such that the direction of the axis line L2 of the roller body 273 becomes same as or similar to the direction orthogonal to the advancing direction R2 of the sheet P. Namely, the roller body 273 is arranged such that the angle θ2 is an acute angle. Accordingly in this modification, it is possible to obtain the effect similar to that obtained in the above-described embodiment.

Figure 6D:
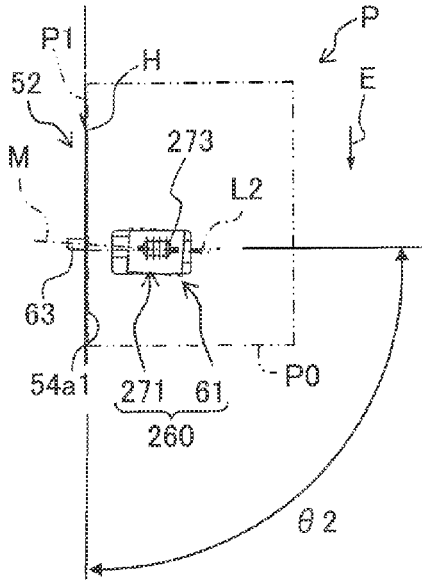
Figure 6D:
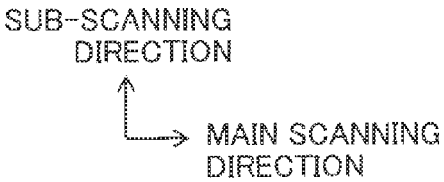

As shown in FIG. 6D, after the side P0 of the sheet P has been brought into contact with the guide surface 54*a*1, the advancing direction of the sheet P is same as the transporting direction E, in a similar manner to that in the above-described embodiment. Further, at this time, the roller body 273 rocks following the advancing direction of the sheet P (transporting direction E), and causes the direction of the axis line L2 of the roller body 273 to become same as or similar to the direction orthogonal to the transporting direction E of the sheet P. Namely, the roller body 273 is arranged such that the angle θ2 is substantially 90 degrees (right angle). Accordingly, in this modification, it is possible to obtain the effect similar to that obtained in the above-described embodiment. Thus, it is possible to position the sheet P in the main scanning direction.

As described above, also in this modification, the same effect can be obtained regarding the configuration similar to that of the above-described embodiment. Further, in the modification, the projection 273*c* serving as the rocking center of the roller body 273 is formed on the roller body 273. Accordingly, the rocking mechanism for making the rocking motion of the roller body 273 with respect to the shaft portion 74 can be realized easily, in addition, even in a case that the roller body 273 is shifted (deviated) along the axis line direction of the shaft portion 74 to some extent, the rocking center of the roller body 273 is not changed. More specifically, even in a case that the roller body 273 is moved along the direction of the axis line L1 of the shaft portion 74 and thus the positional relationship between the roller body 273 and the shaft portion 74 is changed in the direction of the axis line L1 of the shaft portion 74, the positional relationship between the projection 273*c* as the rocking center of the roller body 273 and the both end portions in the extending direction of the roller body 273 (the direction of the axis line L2) is not changed. Thus, the rocking motion of the roller body 273 is stabilized.

In above description, the suitable embodiment of the present teaching has been explained. The present teaching, however, is not limited to the above-described embodiment, and may be modified in various manner within the range described in the appended claims. For example, although the spur rollers 71, 271 having the spurs 72 are adopted as the driven rollers in the embodiment and the modification, respectively, it is allowable that a roller having no spurs 72 (such as a rubber roller, a resin roller, etc.) is adopted as the driven roller. Further, it is allowable that the spur rollers 71, 271 may be arranged such that the axis line L1 of the shaft portion 74 is parallel to the main scanning direction, namely such that the axis line L1 is orthogonal to the guide surface 54*a*1. Furthermore, it is allowable that the spur rollers 71, 271 are arranged upstream or downstream of the guide surface 54*a*1 with respect to the transporting direction E, at a position not overlapping with the guide surface 54*a*1. Moreover, it is allowable that each of the spur rollers 71, 271 does not have the configuration wherein only one roller body 73, 273 is provided with respect to one shaft portion 74; it is allowable that two or more pieces of the roller body 73, 273 is provided with respect to one shaft portion 74. Further, although each of the spur rollers 71, 271 has four spurs 72, 272, it is allowable that each of the spur rollers 71, 271 has not more than three spurs, or not less than five spurs. Furthermore, the positioning mechanism 50 may be provided inside the downstream guide portion 3*b*. With this, the sheet P is discharged to the sheet discharge section 4 in a state that the sheet P is positioned. Further, although the roller body 73 and the roller body 273 are a cylindrical shape having a cross section of circular shape in the embodiment and the modification, respectively, it is allowable that the roller body 73, 273 may have a tube shape with the outer circumference having the cross section of, for example, cam shape and quadrangular shape. In this case, it is preferable for the inner circumference of the tube shaped roller body to have cross section of circular shape. Furthermore, although the guide surface 54*a*1 extends linearly along the sub-scanning direction in the embodiment and the modification, the guide surface 54*a*1 can be other shapes such as corrugated shape etc.

Further, in the above embodiment, the projection 74*b* having the outer diameter slightly smaller than the inner diameter of the roller body 73 is provided on the shaft portion 74. However, there is no limitation to this. It is allowable to adopt such a construction that, for example, a projection having an outer diameter slightly larger than the inner diameter of the roller body 73 is provided on the shaft portion 74, an annular slot is provided on the inner circumferential surface 73*b* of the roller body 73 along the circumferential direction, and the roller body 73 is supported by engaging the projection 74*b* and the slot slidably on each other. Alternatively, it is allowable to adopt such a construction that, the shaft portion 74 does not have the projection 74*b*, and the roller body 73 is supported by the aid of a plurality of balls arranged between the shaft portion 74 and the roller body 73 so as to surround the shaft portion 74 in the circumferential direction. In this construction, it is possible to retain the plurality of balls at the predetermined position by slidably engaging the balls to an annular slot provided on the inner circumferential surface 73*b* of the roller body 73 along the circumferential direction and to an annular slot provided on an outer circumferential surface 74*a* of the shaft portion 74 along the circumferential direction. Those construction also enable rockbale support of the roller body 73 with the shaft portion 74. Further, those constructions can be adopted in the above modification. Specifically, it is allowable to adopt such a construction that, for example, a projection 273*c* having an inner diameter slightly smaller than the outer diameter of the shaft portion 74 is provided on the roller body 273, an annular slot is provided on the outer circumferential surface 74*a* of the shaft portion 74 along the circumferential direction, and the roller body 273 is supported by engaging the projection 273*c* and the slot slidably on each other.

The present teaching is applicable to both the line-type and serial-type printers. Further, the present teaching is applicable to facsimile machines, copying machines, etc. without being limited to the printers. Furthermore, the present teaching is applicable also to any type of recording apparatuses provided that the apparatuses are configured to recording an image, for example, to a laser-type recording apparatus, a thermal-type recording apparatus, etc. The recording medium is not limited to the sheet P, and may be a variety of kinds of media on which any information can be recorded.

What is claimed is:

1. A recording apparatus comprising:

a recording unit configured to record an image on a recording medium; and a transporting mechanism configured to transport the recording medium in a transporting direction along a transporting path through which the recording medium is transported;

wherein the transporting mechanism includes:

a guide surface which extends in a linear manner and which is configured to guide a side edge of the recording medium; and a pair of rollers arranged at a position, in an orthogonal direction orthogonal to the guide surface, between the guide surface and a central portion of the transporting path in the orthogonal direction, the pair of rollers being configured to transport the recording medium by rotating while holding the recording medium between the pair of rollers;

wherein the pair of rollers includes:

a driving roller configured to transport the recording medium; and a driven roller including:

a rotary portion facing a recording surface, of the recording medium, and configured to rotate following movement of the recording medium; and a first shaft inserted through the rotary portion and configured to support the rotary portion rotatably in a circumferential direction of the first shaft;

wherein the rotary portion is supported rockably with respect to the first shaft;

wherein the driving roller includes a second shaft portion constituting a rotation axis of the driving roller; and wherein the second shaft portion is arranged such that an angle defined by an axis line of the second shaft portion and a downstream portion of the guide surface is an acute angle, the downstream portion being located, in the transporting direction, on a downstream side of an intersection between the guide surface and the axis line of the second shaft portion.

2. A recording apparatus comprising:

a recording unit configured to record an image on a recording medium; and a transporting mechanism configured to transport the recording medium in a transporting direction along a transporting path through which the recording medium is transported;

wherein the transporting mechanism includes:

a guide surface which extends in a linear manner and which is configured to guide a side edge of the recording medium; and a pair of rollers arranged at a position, in an orthogonal direction orthogonal to the guide surface, between the guide surface and a central portion of the transporting path in the orthogonal direction, the pair of rollers being configured to transport the recording medium by rotating while holding the recording medium between the pair of rollers;

wherein the pair of rollers includes:

a driving roller configured to transport the recording medium; and a driven roller including:

a rotary portion facing a recording surface, of the recording medium, and configured to rotate following movement of the recording medium; and a first shaft inserted through the rotary portion and configured to support the rotary portion rotatably in a circumferential direction of the first shaft;

wherein the rotary portion is supported rockably with respect to the first shaft; and wherein the driven roller is arranged such that an angle defined by an axis line of the first shaft and a downstream portion of the guide surface is an acute angle, the downstream portion being located, in the transporting direction, on a downstream side of an intersection between the guide surface and the axis line of the first shaft.

3. A recording apparatus comprising:

a recording unit configured to record an image on a recording medium; and a transporting mechanism configured to transport the recording medium in a transporting direction along a transporting path through which the recording medium is transported;

wherein the transporting mechanism includes:

a guide surface which extends in a linear manner and which is configured to guide a side edge of the recording medium; and a pair of rollers arranged at a position, in an orthogonal direction orthogonal to the guide surface, between the guide surface and a central portion of the transporting path in the orthogonal direction, the pair of rollers being configured to transport the recording medium by rotating while holding the recording medium between the pair of rollers;

wherein the pair of rollers includes:

a driving roller configured to transport the recording medium; and a driven roller including:

a rotary portion facing a recording surface, of the recording medium, and configured to rotate following movement of the recording medium; and a first shaft inserted through the rotary portion and configured to support the rotary portion rotatably in a circumferential direction of the first shaft;

wherein the rotary portion is supported rockably with respect to the first shaft;

wherein the rotary portion is a hollow cylindrical member, a cross section of an inner circumferential surface of the hollow cylindrical member being a circular shape;

wherein an annular-shaped projection is formed on the inner circumferential surface of the rotary portion of the driven roller; and wherein a tip portion of the annular-shaped projection contacts an outer circumferential surface of the first shaft so as to serve as a rocking center of the rocking motion of the rotary portion with respect to the first shaft.

4. A recording apparatus comprising:

a recording unit configured to record an image on a recording medium; and a transporting mechanism configured to transport the recording medium in a transporting direction along a transporting path through which the recording medium is transported;

wherein the transporting mechanism includes:

a guide surface which extends in a linear manner and which is configured to guide a side edge of the recording medium; and a pair of rollers arranged at position in an orthogonal direction orthogonal to the guide surface, between the guide surface and a central portion of the transporting path in the orthogonal direction, the pair of rollers being configured to transport the recording medium by rotating while holding the recording medium between the pair of rollers;

wherein the pair of rollers includes:

a driving roller configured to transport the recording medium; and a driven roller including:

a rotary portion facing a recording surface, of the recording medium, and configured to rotate following movement of the recording medium; and a first shaft inserted through the rotary portion and configured to support the rotary portion rotatably in a circumferential direction of the first shaft;

wherein the rotary portion is supported rockably with respect to the first shaft;

wherein the rotary portion is a hollow cylindrical member, a cross section of an inner circumferential surface of the hollow cylindrical member being a circular shape;

wherein an annular-shaped projection is formed on an outer circumferential surface of the first shaft of the driven roller; and wherein a tip portion of the annular-shaped projection contacts the inner circumferential surface of the rotary portion so as to serve as a rocking center of the rocking motion of the rotary portion with respect to the first shaft.

5. A recording apparatus comprising:

a recording unit configured to record an image on a recording medium; and a transporting mechanism configured to transport the recording medium in a transporting direction along a transporting path through which the recording medium is transported;

wherein the transporting mechanism includes:

a guide surface which extends in a linear manner and which is configured to guide a side edge of the recording medium; and a pair of rollers arranged at a position, in an orthogonal direction orthogonal to the guide surface, between the guide surface and a central portion of the transporting path in the orthogonal direction, the pair of rollers being configured to transport the recording medium by rotating while holding the recording medium between the pair of rollers;

wherein the pair of rollers includes:

a driving roller configured to transport the recording medium; and a driven roller including;

a rotary portion facing a recording surface, of the recording medium, and configured to rotate following movement of the recording medium; and a first shaft inserted through the rotary portion and configured to support the rotary portion rotatablv in a circumferential direction of the first shaft;

wherein the rotary portion is supported rockably with respect to the first shaft; and wherein the rotary portion includes at least one spur.

6. A recording apparatus comprising:

a recording unit configured to record an image on a recording medium; and a transporting path via which the recording medium, having the image recorded thereon by the recording unit, is transported in a predetermined direction;

a guide which is arranged at an end portion of the transporting path, the end portion being an end in a width direction orthogonal to the predetermined direction, and which is configured to restrict movement of the recording medium in the width direction; and a pair of rollers arranged between the guide and a central portion in the width direction of the transporting path, the pair of rollers including:

a driving roller configured to move the recording medium in the predetermined direction; and a driven roller arranged to face the driving roller and configured to rotate according to rotation of the driving roller or movement of the recording medium;

wherein the driven roller includes a shaft, and a rotary portion attached to the shaft so as to rotate in a circumferential direction of the shaft;

wherein a rotational center axis of the rotary portion is movable with respect to a center axis of the shaft;

wherein the driving roller includes a second shaft portion constituting a rotation axis of the driving roller; and wherein the second shaft portion is arranged such that an angle defined by an axis line of the second shaft portion and a downstream portion of the guide is an acute angle, the downstream portion being located, in the predetermined direction, on a downstream side of an intersection between the guide and the axis line of the second shaft portion.

7. The recording apparatus according to claim 6;
wherein the rotary portion is a hollow cylindrical member, a cross section of an inner circumferential surface of the hollow cylindrical member being a circular shape.
8. The recording apparatus according to claim 6;
wherein the rotary portion is a hollow cylindrical member, a cross section of an outer circumferential surface of the hollow cylindrical member being a circular shape.
9. The recording apparatus according to claim 6;
wherein the driven roller is arranged at a position overlapping with the guide in the predetermined direction.
10. A recording apparatus comprising:
a recording unit configured to record an image on a recording medium;
a transporting path via which the recording medium, having the image recorded thereon by the recording unit, is transported in a predetermined direction;
a guide which is arranged at an end portion of the transporting path, the end portion being an end in a width direction orthogonal to the predetermined direction, and which is configured to restrict movement of the recording medium in the width direction; and
a pair of rollers arranged between the guide and a central portion in the width direction of the transporting path, the pair of rollers including:
a driving roller configured to move the recording medium in the predetermined direction; and
a driven roller arranged to face the driving roller and configured to rotate according to rotation of the driving roller or movement of the recording medium;
wherein the driven roller includes a shaft, and a rotary portion attached to the shaft so as to rotate in a circumferential direction of the shaft;
wherein a rotational center axis of the rotary portion is movable with respect to a center axis of the shaft; and
wherein the driven roller is arranged such that an angle defined by an axis line of the shaft and a downstream portion of the guide is an acute angle, the downstream portion being located, in the predetermined direction, on a downstream side of an intersection between the guide and the axis tine of the shaft.
11. The recording apparatus according to claim 10;
wherein the rotary portion is a hollow cylindrical member, a cross section of an inner circumferential surface of the hollow cylindrical member being a circular shape.
12. The recording apparatus according to claim 10;
wherein the rotary portion is a hollow cylindrical member, a cross section of an outer circumferential surface of the hollow cylindrical member being a circular shape.
13. The recording apparatus according to claim 10;
wherein the driving roller includes a second shaft portion constituting a rotation axis of the driving roller; and
wherein the second shaft portion is arranged so that an axis line of the second shaft portion is orthogonal to the guide.
14. The recording apparatus according to claim 10;
wherein the driven roller is arranged at a position overlapping with the guide in the predetermined direction.
15. A recording apparatus comprising:
a recording unit configured to record an image on a recording medium;
a transporting path via which the recording medium, having the image recorded thereon by the recording unit, is transported in a predetermined direction;
a guide which is arranged at an end portion of the transporting path, the end portion being an end in a width direction orthogonal to the predetermined direction, and which is configured to restrict movement of the recording medium in the width direction; and
a pair of rollers arranged between the guide and a central portion in the width direction of the transporting path, the pair of rollers including:
a driving roller configured to move the recording medium in the predetermined direction; and
a driven roller arranged to face the driving roller and configured to rotate according to rotation of the driving roller or movement of the recording medium;
wherein the driven roller includes a shaft, and a rotary portion attached to the shaft so as to rotate in a circumferential direction of the shaft;
wherein a rotational center axis of the rotary portion is movable with respect to a center axis of the shaft;
wherein the rotary portion is a hollow cylindrical member, a cross section of an inner circumferential surface of the hollow cylindrical member being a circular shape;
wherein an annular-shaped projection is formed on the inner circumferential surface of the rotary portion of the driven roller; and
wherein a tip portion of the annular-shaped projection contacts an outer circumferential surface of the shaft so as to serve as a rocking center of the movement of the rotational center axis of the rotary portion with respect to the center axis of the shaft.
16. The recording apparatus according to claim 15;
wherein a cross section of an outer circumferential surface of the hollow cylindrical member being a circular shape.
17. The recording apparatus according to claim 15;
wherein the driving roller includes a second shaft portion constituting a rotation axis of the driving roller; and
wherein the second shaft portion is arranged so that an axis line of the second shaft portion is orthogonal to the guide.
18. The recording apparatus according to claim 15;
wherein the driven roller is arranged at a position overlapping with the guide in the predetermined direction.
19. A recording apparatus comprising:
a recording unit configured to record an image on a recording medium;
a transporting path via which the recording medium, having the image recorded thereon by the recording unit, is transported in a predetermined direction;
a guide which is arranged at an end portion of the transporting path, the end portion being an end in a width direction orthogonal to the predetermined direction, and which is configured to restrict movement of the recording medium in the width direction; and
a pair of rollers arranged between the guide and a central portion in the width direction of the transporting path, the pair of rollers including:
a driving roller configured to move the recording medium in the predetermined direction; and
a driven roller arranged to face the driving roller and configured to rotate according to rotation of the driving roller or movement of the recording medium;
wherein the driven roller includes a shaft, and a rotary portion attached to the shaft so as to rotate in a circumferential direction of the shaft;
wherein a rotational center axis of e rotary portion is movable with respect to a center axis of the shaft;
wherein the rotary portion is a hollow cylindrical member, a cross section of an inner circumferential surface of the hollow cylindrical member being a circular shape;

wherein an annular-shaped projection is formed on an outer circumferential surface of the shaft of the driven roller; and wherein a tip portion of the annular-shaped projection contacts the inner circumferential surface of the rotary portion so as to serve as a rocking center of the movement of the rotational center axis of the rotary portion with respect to the center axis of the shaft.

20. A recording apparatus comprising:

a recording unit configured to record an image on a recording medium;

a transporting path via which the recording medium, having the image recorded thereon by the recording unit, is transported in a predetermined direction;

a guide which is arranged at an end portion of the transporting path, the end portion being an end in a width direction orthogonal to the predetermined direction, and which is configured to restrict movement of the recording medium in the width direction; and a pair of rollers arranged between the guide and a central portion in the width direction of the transporting path, the pair of rollers including:

a driving roller configured to move the recording medium in the predetermined direction; and a driven roller arranged to face the driving roller and configured to rotate according to rotation of the driving roller or movement of the recording medium;

wherein the driven roller includes a shaft, and a rotary portion attached to the shaft so as to rotate in a circumferential direction of the shaft;

wherein a rotational center axis of the rotary portion is movable with respect to a center axis of the shaft; and wherein the rotary portion includes at least one spur.

* * * * *